US011801436B2

(12) United States Patent
Brown et al.

(10) Patent No.: US 11,801,436 B2
(45) Date of Patent: Oct. 31, 2023

(54) SKI BINDING SUSPENSION SYSTEM FOR VERTICAL LOAD TRANSMISSION

(71) Applicant: Worcester Polytechnic institute, Worcester, MA (US)

(72) Inventors: Christopher A. Brown, Waterbury, VT (US); Madison M. Healey, Atkinson, NH (US); Matthew Newell, Hardwick, MA (US); Kendra S. O'Malley, Charlton, MA (US); Connor H. O'Neill, Spencerport, NY (US)

(73) Assignee: Worcester Polytechnic Institute, Worcester, MA (US)

( * ) Notice: Subject to any disclaimer, the term of this patent is extended or adjusted under 35 U.S.C. 154(b) by 0 days.

(21) Appl. No.: 17/499,052

(22) Filed: Oct. 12, 2021

(65) Prior Publication Data

US 2022/0023743 A1 Jan. 27, 2022

Related U.S. Application Data

(63) Continuation of application No. PCT/US2020/027918, filed on Apr. 13, 2020.

(60) Provisional application No. 62/832,815, filed on Apr. 11, 2019.

(51) Int. Cl.
*A63C 9/00* (2012.01)

(52) U.S. Cl.
CPC ..... *A63C 9/003* (2013.01); *A63C 9/007* (2013.01); *A63C 2203/20* (2013.01)

(58) Field of Classification Search
CPC ..... A63C 5/075; A63C 9/003; A63C 9/007; A63C 17/0046; A63C 2203/20
See application file for complete search history.

(56) References Cited

U.S. PATENT DOCUMENTS

| | | | | |
|---|---|---|---|---|
| 4,565,386 A * | 1/1986 | Crainich | A63C 5/075 | 280/607 |
| 4,639,009 A | 1/1987 | Meatto et al. | | |
| 5,213,355 A * | 5/1993 | Juhasz | F16F 9/096 | 280/602 |
| 5,499,836 A * | 3/1996 | Juhasz | F16F 9/096 | 280/607 |
| 5,681,054 A | 10/1997 | Bonvallet | | |
| 5,779,257 A * | 7/1998 | Bonvallet | A63C 5/07 | 280/612 |
| 9,950,242 B2 * | 4/2018 | Wilson | A63C 5/07 | |

(Continued)

FOREIGN PATENT DOCUMENTS

RU 2338568 C2 11/2008

*Primary Examiner* — Brian L Swenson
(74) *Attorney, Agent, or Firm* — Armis IP Law, LLC

(57) ABSTRACT

An impact absorbing ski binding interface device includes an elongated top plate having a toe end and a heel end adapted to engage a boot toe and a boot heel, respectively, and a bottom plate adapted to engage a ski, thereby securing the device between the boot and ski. A plurality of constant force spring linkages between the top plate and the bottom plate include a constant force spring linkage between the toe end and the bottom plate, and a constant force spring linkage between the heel end and the bottom plate, such that each of the constant force spring linkages have an opposed pair of deformable members for exerting a counterforce to vertical displacement forces between the top plate and the bottom plate for load mitigation.

11 Claims, 6 Drawing Sheets

(56) References Cited

U.S. PATENT DOCUMENTS

| | | | | |
|---|---|---|---|---|
| 10,099,108 | B2 * | 10/2018 | Briggs | A63C 5/07 |
| 2002/0024187 | A1 * | 2/2002 | Gyr | A63C 5/07<br>280/14.22 |
| 2006/0226613 | A1 * | 10/2006 | Wilson | A63C 5/07<br>280/14.22 |
| 2007/0182129 | A1 * | 8/2007 | Wilson | A63C 9/003<br>280/602 |

* cited by examiner

FIG. 2A
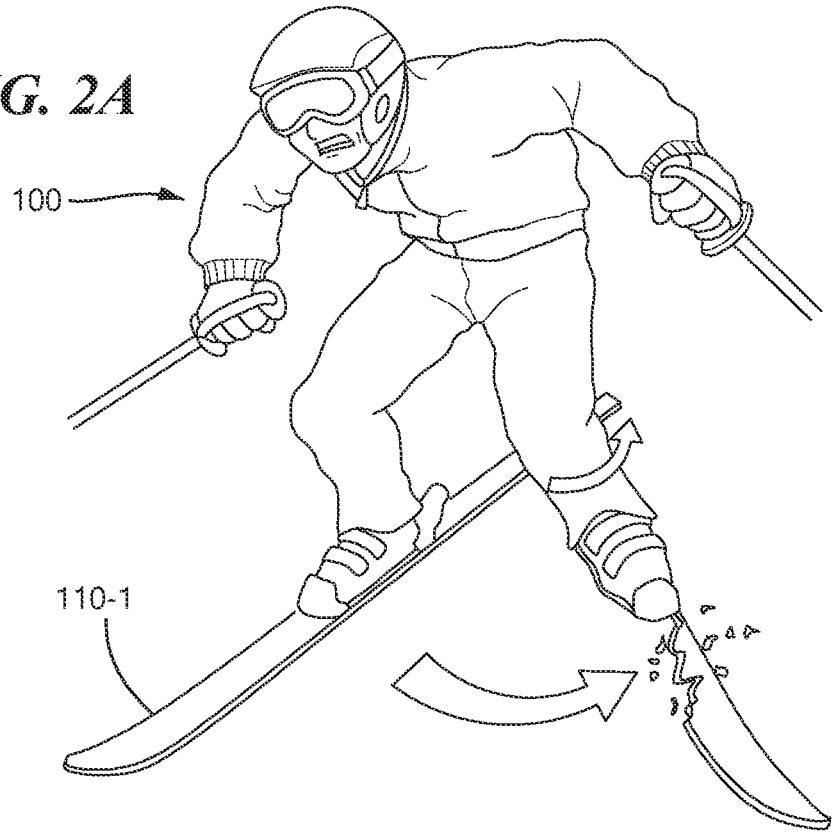
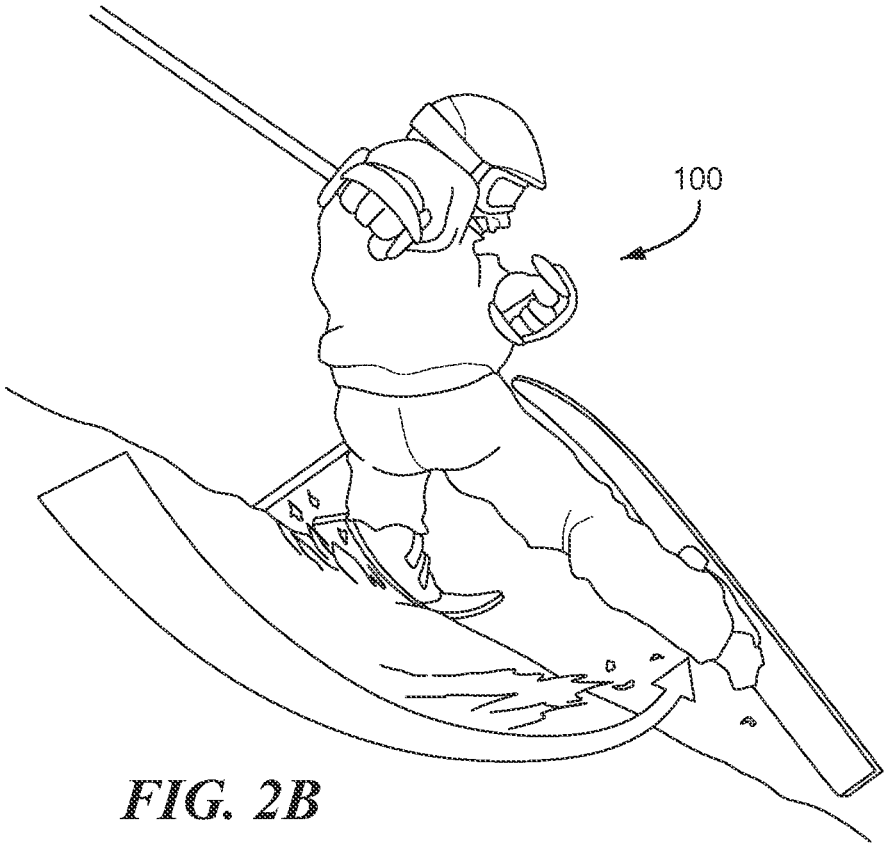
FIG. 2B

SKI BINDING SUSPENSION SYSTEM FOR VERTICAL LOAD TRANSMISSION

BACKGROUND

Athletic injuries, such as from overstressed musculoskeletal structures, can be traumatic and career ending. ACL (Anterior Cruciate Ligament) injuries are particularly notorious and prone to recurrence. These and other injuries often result from some form of loads (e.g., forces and torques) transferred through the footwear of the athlete to the foot and on to an anatomical member, such as a bone, ligament, cartilage, tendon or other tissue structure. Mitigation of the transfer of these loads can substantially eliminate or alleviate injury risk to the foot, ankle, lower leg and knee. Skiers in particular are more susceptible to harmful force transmission because the foot interface encompasses the entire foot and ankle in a rigid, unyielding manner. Further, the skis can operate as a lever to magnify forces in the event of a hard turn or fall, and generally occur at high velocity.

Skiing injuries can result from improperly distributed forces, particularly in the knee joint due to the complex bone structure and tendency of skiing to concentrate force in the knee, since the ankle is largely fixed in the boot. Tibial plateau bruising and back problems can be associated with hard, injected surfaces for racing. One of the two main ACL injury mechanisms is boot induced anterior drawer (BIAD), where an anterior shear load at the knee is produced by a forward torque transmitted from the tail of the ski, through a boot stiff in backward lean.

SUMMARY

A spring and lever absorption system attaches to a ski at standard binding mounting locations with the ski bindings attaching to the top of a low-profile plate. The plate is supported on a system of nonlinear springs located at the front and back of the plate allowing it to rotate about the heel and toe of the boot as well as move vertically and accommodate ski flex. When a load exceeds ordinary skiing loads, indicating a possible injurious load, the system displaces to absorb some of the load through the springs. Additionally, high frequency vibrations (chatter) can be mitigated through vertical displacement of the boot, thereby reducing impulse.

Configurations herein are based, in part, on the observation that skiing generates substantial forces between the boot and binding based on velocity of the skier over the snow surface traversed by the skis. Conventional approaches to skiing incorporate ski bindings that selectively secure the ski boot to the ski, and are designed to pivot the toe of the boot out of engagement with the ski for preventing injury. Unfortunately, conventional approaches to ski bindings suffer from the shortcoming that they offer only minimal absorption of the forces that are transferred during skiing and fail to account for vertical loads and fore-aft torques while skiing. Accordingly, configurations herein substantially overcome the above-described shortcomings through a ski binding suspension to address inadvertent heel release and reduce anterior cruciate ligament (ACL), tibial plateau, and back injuries.

An impact absorbing ski binding interface device discussed below includes an elongated top plate having a toe end and a heel end adapted to engage a boot toe and a boot heel, respectively, and a bottom plate adapted to engage a ski, thereby securing the device between the boot and ski. A plurality of constant force spring linkages between the top plate and the bottom plate include a constant force spring linkage between the toe end and the bottom plate, and a constant force spring linkage between the heel end and the bottom plate, such that each of the constant force spring linkages each have an opposed pair of deformable members for exerting a counterforce to vertical displacement forces between the top plate and the bottom plate for load mitigation.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

FIGS. 2A-2C show a sequence of skiing maneuvers leading to combined valgus, inward rotation forces;

DETAILED DESCRIPTION

Conventional ski binding systems are designed to have a single pivot point to allow rotation about the boot heel, making the binding-release system ignore applied loads located at or near the heel. Enhancements to binding systems have attempted to change the point of rotation by either shifting the location or adding a second pivot point, but are still largely agnostic to forces around the heel, and instead emphasize a release at the toe by rotating or opening the binding toe, leaving the heel substantially fixed.

Figure 1:
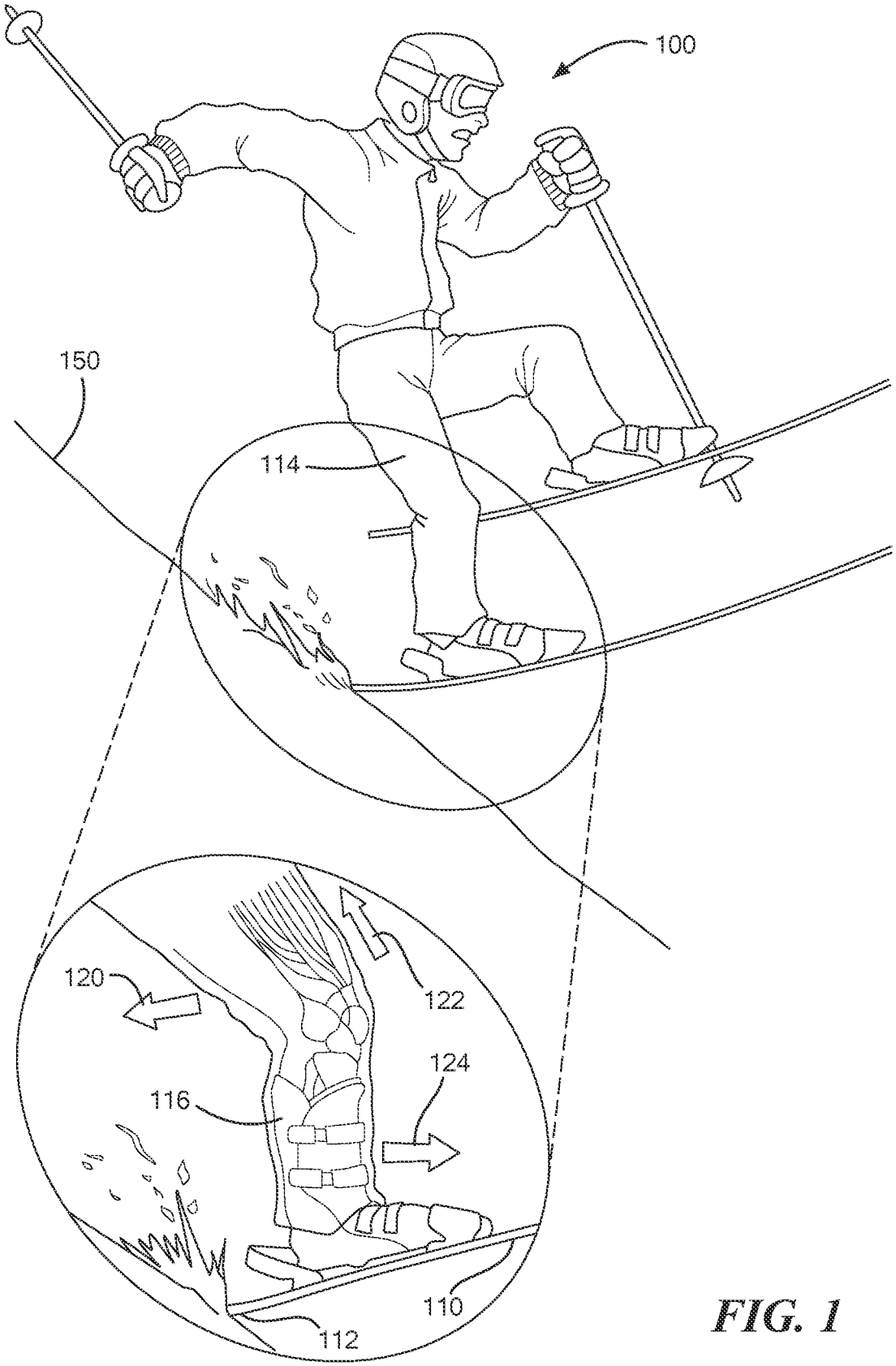
FIG. 1 shows forces in a skier boot/binding configuration.

FIG. 1 shows forces in a skier boot/binding configuration. ACL injuries are particular notorious due to an extended and uncertain recovery scenario, and are often caused by the rearward and heel-centric forces that conventional binding have little effect on. The two most common ways of injuring an ACL while skiing include boot induced anterior drawer (BIAD) and combined valgus, inward rotation (CVIR). These two mechanisms along with combined valgus, external rotation make up the three mechanisms for injuring the ACL while skiing. Referring to FIG. 1, an example of boot induced anterior drawer (BIAD) that occurs when a skier 100 loses their balance backwards while in the air.

The skier 100 then lands on the tail 112 of their skis 110 with legs 114 extended on a hard snow surface 150. As the skier 100 lands, the loads are transferred through the skis, bindings, and stiff boots, resulting in an anterior drawer of the tibia relative to the femur. The lack of flexibility in the back of the ski boot 116 holds the tibia in place during impact, following arrow 124, while the center of mass of the skier 100 continues to fall backwards (arrow 120), pulling the femur off of the tibia (arrow 122). This landing puts sufficient strain on the ACL, potentially causing injuries.

Figure 2C:
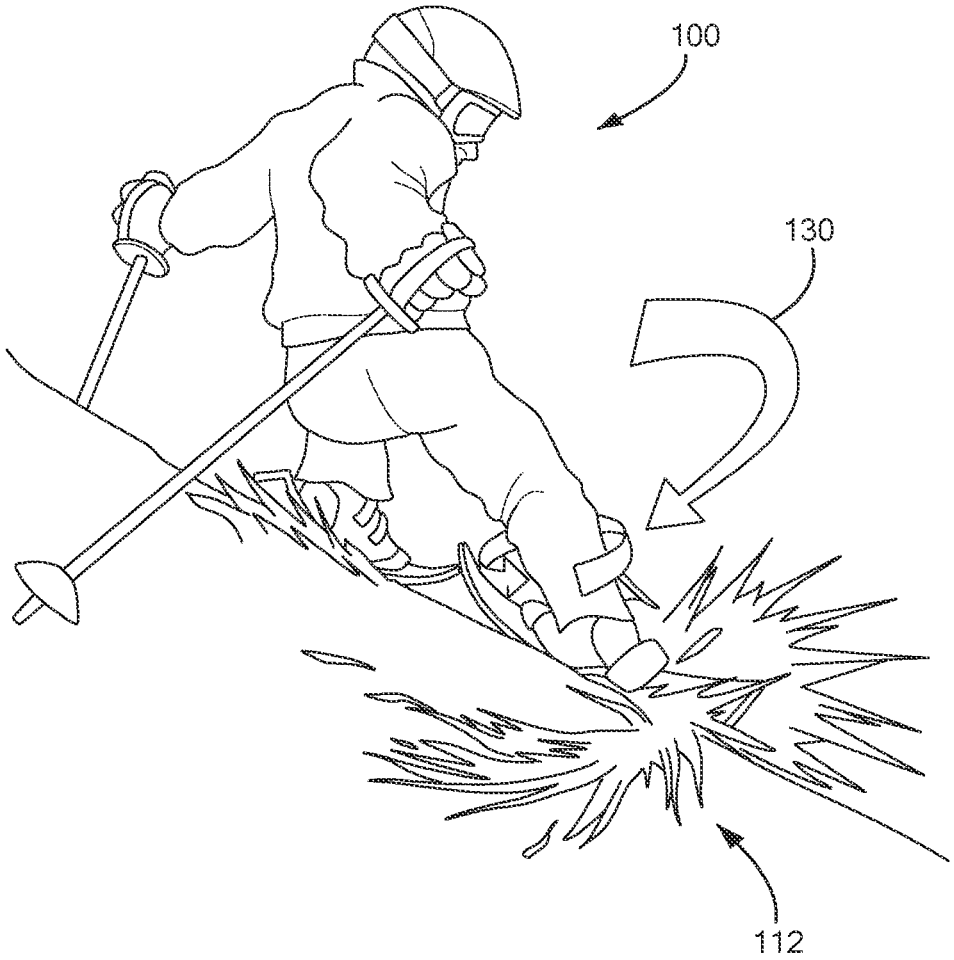

FIGS. 2A-2C show a sequence of skiing maneuvers leading to combined valgus, inward rotation forces. Referring to FIGS. 2A-2C, combined valgus, inward rotation (CVIR) occurs when the skier's body is facing downhill, their uphill arm is back, and their balance is backwards with no weight on the uphill ski 110-1, as in FIG. 2A. The skier's hips are down near or lower than their knees with their weight on the inside edge of the downhill as in FIG. 2B. As the downhill ski engages with the snow, the inside edge at the tail 112 engages, rotating the downhill knee inwards following arrow 130. This rotation causes the ACL to unnaturally twist, potentially causing the ACL to tear.

Figure 3:
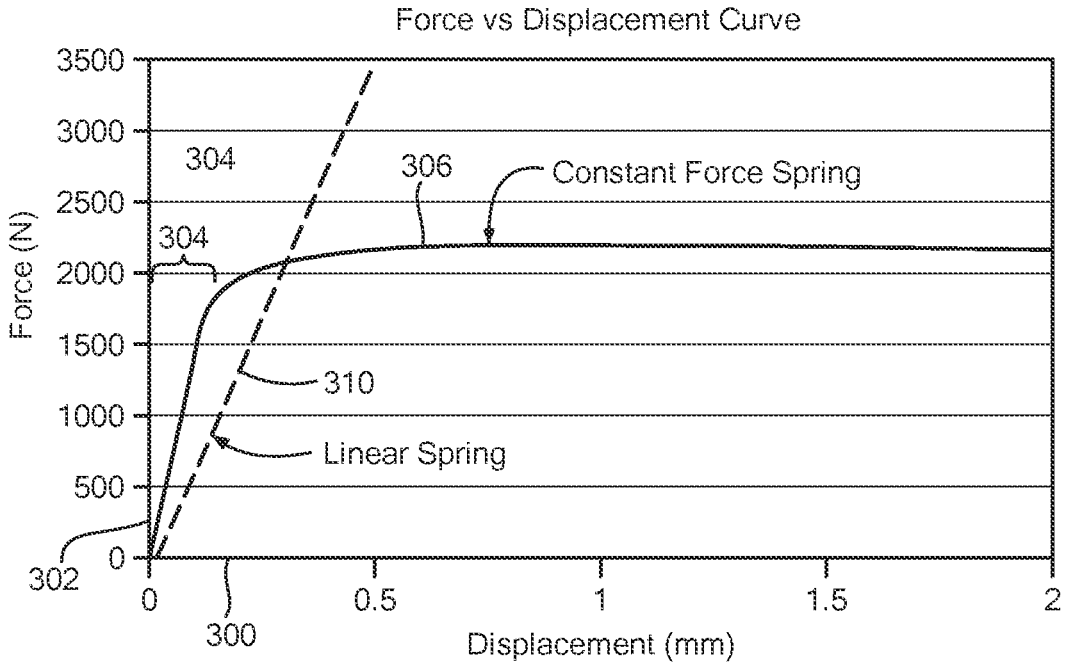
FIG. 3 shows a graph of forces dissipated by the approach herein.

FIG. 3 shows a graph of forces dissipated by the approach herein. Referring to FIG. 3, conventional linear springs exhibit a linear increase to counterforce as a displacement, (i.e. stretching) on vertical axis 302 against the spring increases, as shown by line 310 against a horizontal displacement axis 300. The linear response does little to mitigate harmful force as after a small displacement the counterforce is responsive at an injurious level. In contrast, a constant force spring responds with a near level (constant) force after a short initial displacement 304, as shown by line 306.

Figure 4:
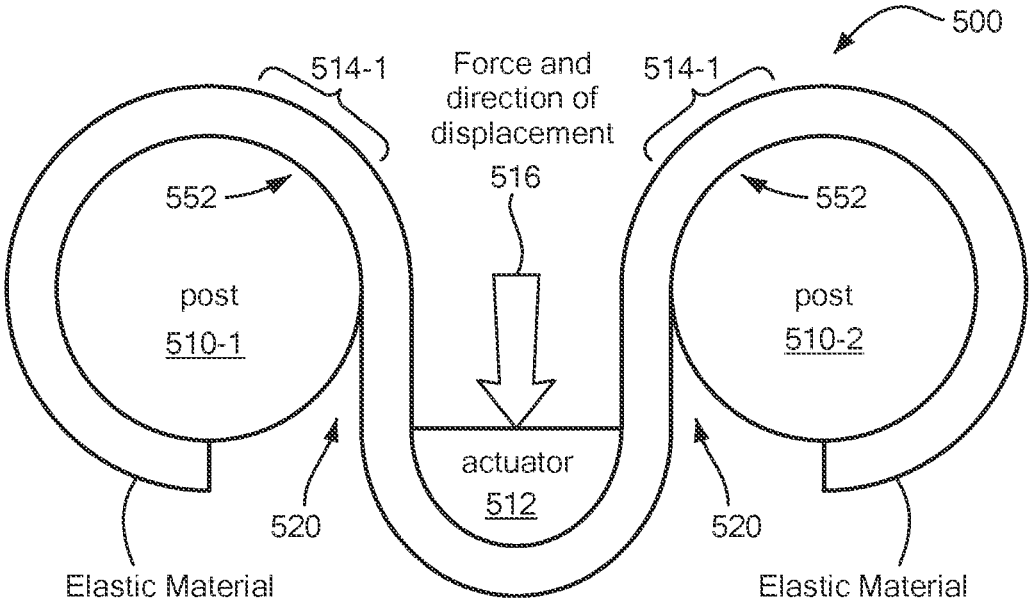
FIG. 4 show an implementation of a spring exhibiting the mitigating forces of FIG. 3.

FIG. 4 show an implementation of a spring exhibiting the mitigating forces of FIG. 3. Referring to FIGS. 3 and 4, FIG. 4 is a configuration of a constant force spring according to the force response of line 306. The spring 500 is responsive with a substantially constant force, rather than a linearly increasing force.

FIG. 4 shows a dual post approach including two rigid members 510-1 . . . 510-2 (510 generally) flanking a central actuator 512. An elongated member 550 spans the plurality of rigid members 510, such that at least one rigid member extends from the linkage to the wearer interface, and the elongated member 550 is in slidable communication with at least two of the rigid members 510 for deformation responsive to the received force. Each rigid member 510 has a corresponding elastic field 514-1 . . . 514-2 (514 generally) for responding uniformly to a received actuation force 516. In response to the received force, the central actuator 512 travel is mitigated by a reactive force 520 from the elongated member 550, which takes the form of dual spirals emanating from a central actuator and tends to have an appearance of a head of a goat with the spirals denoting horns.

The effect of the spiral biased around the post, or rigid member 510, is that the elastic field includes a deformation section 552 defined by a segment of the elongated member 50 in contact with and deforming from a curved to straight orientation around the rigid member 510. The segment has a length that remains substantially constant during contact with the rigid member 510 while the elongated member 550 deforms to a straight position as it "unwinds" the spiral. In general, the rigid member 510 extends substantially perpendicular to the ski 110, and is coupled to the linkage for receiving the vertical movement component based on activity of the skier and binding. Some additional friction may be encountered by the length of the elongated member 550 remaining "wrapped" around the rigid member 510, but such friction can be minimized and/or controlled by appropriate material selection, discussed further below.

Different rigidity and cross section properties may be imparted to the elongated member 550 to vary the reactive force 520 in response to the received force direction 516, as the elongated member 550 is deformed out of a rest position from the bias around the post. The elongated member 550 is typically a homogeneous material with a solid cross section, such as nitinol or similar spring material.

Conventional bindings permit little to no vertical displacement, so when a skier lands, or begins to fall, the maneuver creates a large vertical force transferred though the ski and binding. If this force is large enough and directed upward at the heel, the heel release mechanism in the binding may actuate, releasing the skier from the ski. This system does not allow the skier to recover as the release from the binding is instantaneous. Additionally, because the toe releases laterally, a vertical force above the injury threshold, will release the skier at the heel, but can still cause injury as the toe cannot lift; it is designed to pivot laterally. To mitigate the peak vertical force, configurations herein impose an absorption plate to displace when a large force is generated by the skier. This plate will keep the imposed force on the skier below injury loads using a constant force spring to provide time to recover, in effect "buffering" an otherwise sharp load/force.

Figure 5:
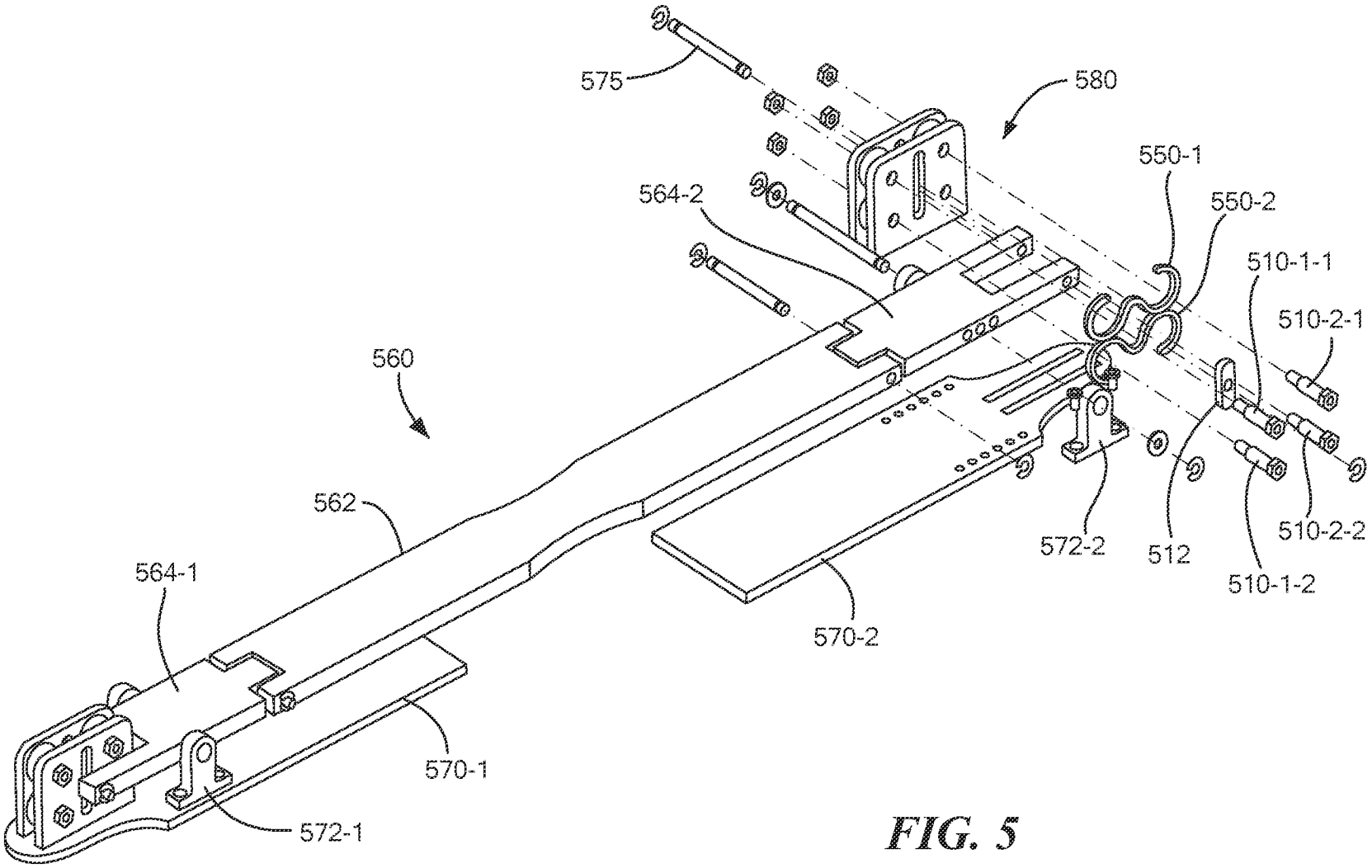
FIG. 5 show an exploded view of a ski binding interface using the spring of FIG. 4.

FIG. 5 show an exploded view of a ski binding interface using the spring of FIG. 4. Referring to FIGS. 4 and 5, a top plate assembly 560 includes a top plate 562 and pivotally connected lever arms 564-1, 564-2 respectively, for the toe and heel ends respectively (564 generally). A bottom plate, which may comprise toe and heel bottom plates 570-1, 570-2 respectively (570 generally), attached to the ski. The top plate assembly 560 is intended to receive most commercially available ski bindings for attachment to the top plate assembly 560, and the bottom plates 570 attach directly to the ski. The lever arms 564 interface with the top plate 562 by a pin and slot system and connect with the actuator 580 and included spring system with an engagement pin 575. A pair of fulcrums 572-1 . . . 572-2 (572 generally) complement the attachment of the lever arms 564 to the bottom plate 570. The stiff boot and binding that is engaged with the skier is able to move relative to the ski when forces approach injurious loads. This displacement causes a decrease in forces applied to the knee and allows the skier additional time to recover and prevent injury. However, during normal skiing loads the constant force springs 550 in the actuator 580 maintain a rigid system so normal skiing performance is preserved. The alternating curvature, or "goat's head" shape of the deformable member 550 is employed in the example actuator 580 for implementing a controllable spring system. The loading and unloading pattern of the spring allows the skier to recover from injurious loads instantaneously without experiencing forces within the muscular and skeletal structure that result in injuries. Alternate spring approaches may be employed for providing a linear spring response for the deformable member 550.

Figure 6:
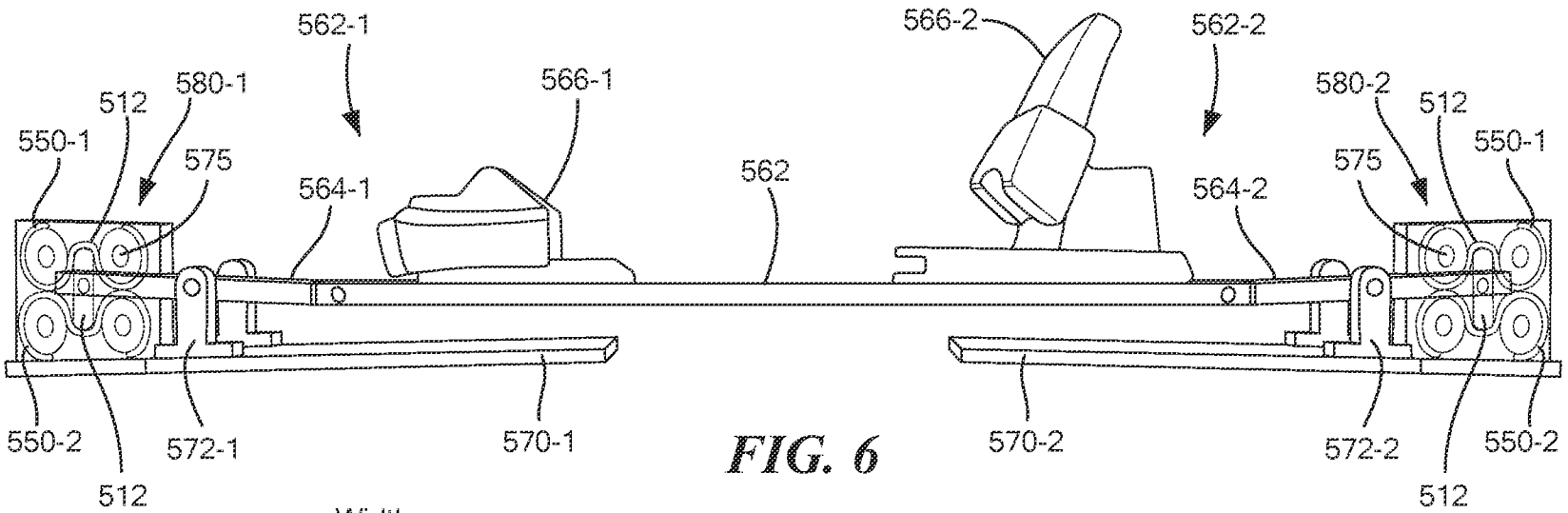
FIG. 6 show the ski binding interface of FIG. 5 engaged with a binding pair.

FIG. 6 show the ski binding interface of FIG. 5 engaged with a binding pair. Referring to FIG. 4-6, the impact absorbing ski binding interface device includes the elongated top plate 562 having a toe end 562-1 and a heel end 562-2 and adapted to engage a boot toe and a boot heel via a toe binding 566-1 and a heel binding 566-2. The bottom plate 570 is adapted to engage a ski 110, and may comprise separate toe 570-1 and heel 570-2 plate portions. A plurality of constant force spring linkages define actuators 580-1 . . . 580-2 (580 generally) between the top plate 562 and the bottom plate 570. The actuator 580-1 provides a constant force spring linkage between the toe end 562-1 and the bottom plate 570-1. The actuator 580-2 provides a constant force spring linkage between the heel end 562-2 and the bottom plate 570-2, such that each of the constant force spring linkages employ at least one deformable member 550 for exerting a counterforce to vertical displacement forces between the top plate and the bottom plate.

The fulcrums 572 and lever arms 564 moderate the vertical forces by pivoted attachment to the top plate 562 and the central actuator 512. Each deformable member 550 exerts a constant force during displacement resulting from a constant sized deformation zone 552 in the deformable member 550, such that the deformation zone 552 is responsive to deform during displacement. The actuator 580 orients the deformable members 550 for responsiveness to upwards and downwards forces. Each actuator 580 includes a pair of opposed deformable members 550-1 . . . 550-2, such that each deformable member of the pair of opposed deformable member is responsive to upward or downward displacement forces, respectively, driven by the central actuator 512 being displaced vertically (relative to the ski) from the ski boot 116.

Figure 7:
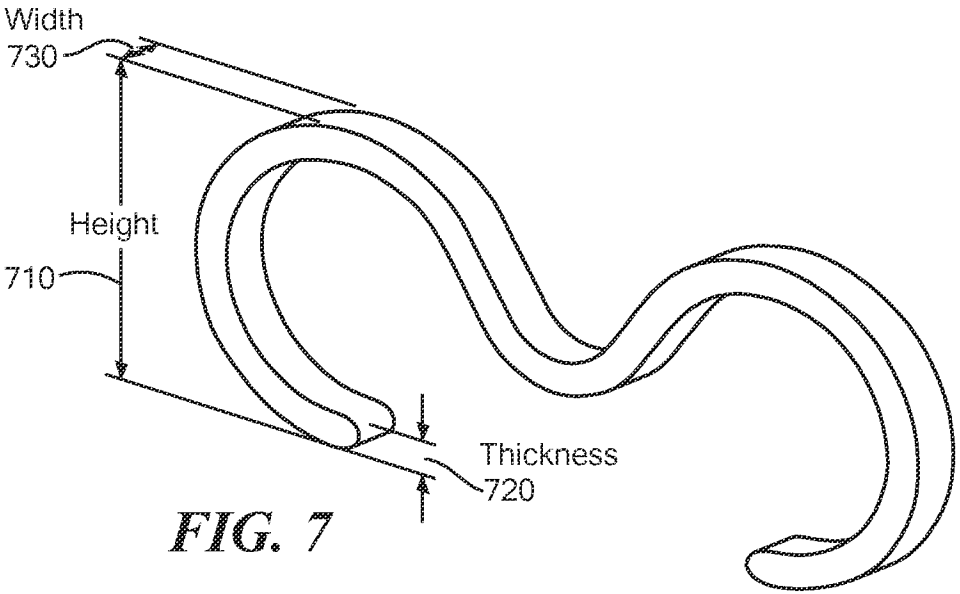
FIG. 7 shows the geometry of the spring of FIG. 4 for tuning a response in the ski binding interface of FIGS. 5 and 6.

FIG. 7 shows the geometry of the spring of FIG. 4 for tuning a response in the ski binding interface of FIGS. 5 and 6. The deformable member 550 defines the constant force spring and exhibits a height 710, a thickness 720 and a width 730. The deformable member may be composed of any suitable material, such as aluminum and carbon spring steel, optionally with Teflon, however nitinol has shown to have appreciable deformability characteristics for providing an effective deformation zone 552 as it slideably engages the rigid member 510.

Strain calculations were used along with material properties and varying dimensions of the spring to get an acceptable force at which the deformable member begins to strain. An applied force ranging from 66.72 to 88.96N (15 to 20 lbs) was determined to be sufficient for prototypic examples to easily displace for interactive demonstrations with minimal exertion. Teflon yielded acceptable force calculations based on the dimensions chosen. It was machined on a CNC mini mill by gluing a sheet of the Teflon to a piece of aluminum stock.

While the system and methods defined herein have been particularly shown and described with references to embodiments thereof, it will be understood by those skilled in the art that various changes in form and details may be made therein without departing from the scope of the invention encompassed by the appended claims.

What is claimed is:

1. In a ski binding securing a boot to a ski for substantially rigid communication of force, an impact absorbing device, comprising:

a pair of near constant force members, each near constant force member defining a linkage between the boot and the ski for mitigating forces between the ski and the boot, and oriented for receiving vertical forces imposed between the boot and the ski, the pair of near constant force members having an opposed orientation, each near constant force member of the pair of near constant force members responsive to an actuator based on actuator movement in a respective opposed direction.

2. The device of claim 1 wherein the near constant force member further comprises a deformable member having an elastic field, the elastic field defined by a segment of the deformable member transitioning between a curved and straight deformation.

3. The device of claim 2 further comprising a linkage responsive to forces between the boot and the ski for drawing the deformable member around a rigid member for deforming a segment of the deformable member from a curved orientation towards a straight orientation in resistance to the force.

4. The device of claim 1 wherein the boot has a toe end and a heel end further comprising a near constant force member engaging the toe end to the ski and a near constant force member engaging the heel end to the ski.

5. The device of claim 4 further comprising a top plate attached to the boot and a bottom plate secured to the ski, and at least one near constant force member defining a linkage between the top plate and the bottom plate.

6. The device of claim 5 further comprising an attachment between the bottom plate and a ski binding for securing the bottom plate to the ski, the ski binding having a toe portion and a heel portion for engaging a respective end of the bottom plate.

7. The device of claim 1 further comprising a respective heel and toe actuator assembly, each actuator assembly including a pair of opposed near constant force members, each of the toe and heel assembly defining a respective linkage between the heel and toe of the boot, and the ski.

8. A method for mitigating force between a ski boot and a ski, comprising:

receiving a vertical force imposed from a ski towards a boot;

drawing a near constant force member around a rigid member in response to the vertical force; and deforming a segment of the near constant force member in an elastic field from a curved orientation around the rigid member towards a straight orientation based on the vertical force.

9. An impact absorbing ski binding interface device, comprising:

an elongated top plate having a toe end and a heel end and adapted to engage a boot toe and a boot heel, respectively;

a bottom plate adapted to engage a ski;

a plurality of near constant force spring linkages between the top plate and the bottom plate, further comprising:

a near constant force spring linkage between the toe end and the bottom plate; and a near constant force spring linkage between the heel end and the bottom plate, each of the constant force spring linkages having at least one deformable member for exerting a counterforce to vertical displacement forces between the top plate and the bottom plate.

10. The device of claim 9 wherein the deformable member exerts a constant force during displacement resulting from a constant sized deformation zone in the deformable member, the deformation zone responsive to deform during displacement.

11. The device of claim 9 wherein each near constant force spring linkage includes a pair of opposed deformable members, each deformable member of the pair of opposed deformable member responsive to upward or downward displacement forces, respectively.

* * * * *